US010352325B2

(12) United States Patent
Hiner et al.

(10) Patent No.: US 10,352,325 B2
(45) Date of Patent: Jul. 16, 2019

(54) LAMINAR FLOW RADIAL CEILING FAN

(71) Applicants: Nicolas A. Hiner, Georgetown, IN (US); Richard W Halsall, Georgetown, IN (US)

(72) Inventors: Nicolas A. Hiner, Georgetown, IN (US); Richard W Halsall, Georgetown, IN (US)

(73) Assignee: EXHALE FANS LLC, Georgetown, IN (US)

( * ) Notice: Subject to any disclaimer, the term of this patent is extended or adjusted under 35 U.S.C. 154(b) by 1298 days.

(21) Appl. No.: 13/662,910

(22) Filed: Oct. 29, 2012

(65) Prior Publication Data

US 2014/0119924 A1 May 1, 2014

(51) Int. Cl.

| | |
|---|---|
| ***F04D 29/22*** | (2006.01) |
| ***F04D 17/16*** | (2006.01) |
| ***F04D 25/08*** | (2006.01) |
| ***F04D 29/68*** | (2006.01) |
| ***F04D 29/66*** | (2006.01) |
| ***F24F 7/007*** | (2006.01) |
| *F04D 29/62* | (2006.01) |
| *F24F 13/24* | (2006.01) |

(52) U.S. Cl.

CPC ..... *F04D 17/161* (2013.01); *F04D 25/088* (2013.01); *F04D 29/667* (2013.01); *F04D 29/681* (2013.01); *F24F 7/007* (2013.01); *F24F 13/24* (2013.01); *F24F 2221/14* (2013.01)

(58) Field of Classification Search

CPC ..... F04D 5/001; F04D 17/16; F04D 17/161; F04D 25/08; F04D 25/088; F04D 29/68; F04D 29/681; F04D 29/703; F01D 1/36; F24F 7/007; F24F 13/24; F24F 2221/14

USPC ..... 415/58.2, 58.4, 58.6, 59.1, 90; 416/4, 416/175, 182, 188, 198 R

See application file for complete search history.

(56) References Cited

U.S. PATENT DOCUMENTS

| | | | | |
|---|---|---|---|---|
| 1,061,142 A | | 5/1913 | Tesla | |
| 2,321,907 A | * | 6/1943 | Gent | F04D 17/161 392/364 |
| 3,978,657 A | | 9/1976 | Fulton et al. | |

(Continued)

OTHER PUBLICATIONS

Romanin, Vincent D. "Theory and Performance of Tesla Turbines," Doctorial Dissertation, UC Berkeley 2012.

*Primary Examiner* — Justin D Seabe
*Assistant Examiner* — Alexander A White
(74) *Attorney, Agent, or Firm* — Scott Houtteman; Houtteman Law LLC

(57) ABSTRACT

The prior art has used pitched blades attached to a stationary motor, normally electric, to move air within the confines of a structure or room. The preferred invention incorporates a series of solid discs. The discs are affixed to a stationary electric motor and thus rotate around a central axis. The discs are equally spaced and centrally perforated in a manner that will allow air to flow in high volumes through the perforations and pass along the discs thus exiting symmetrically between each disc perpendicularly to the flow of air that is at its entrance. Due to the less restrictive or low pressure air entrance as well as the correct vertical disc spacing a corresponding increase in the laminar flow is realized. This feature of the preferred invention allows for operation at a rotational speed that is practical for use as a ceiling fan.

10 Claims, 9 Drawing Sheets

(56) References Cited

U.S. PATENT DOCUMENTS

| | | | | |
|---|---|---|---|---|
| 5,192,182 | A * | 3/1993 | Possell | F01D 1/36 415/143 |
| 6,328,527 | B1 | 12/2001 | Conrad et al. | |
| 8,048,183 | B2 | 11/2011 | Conrad | |
| D676,543 | S | 2/2013 | Hinner et al. | |
| D676,952 | S * | 2/2013 | Hiner | D23/377 |
| 2010/0111720 | A1 * | 5/2010 | Hiner | F04D 5/001 417/321 |

* cited by examiner

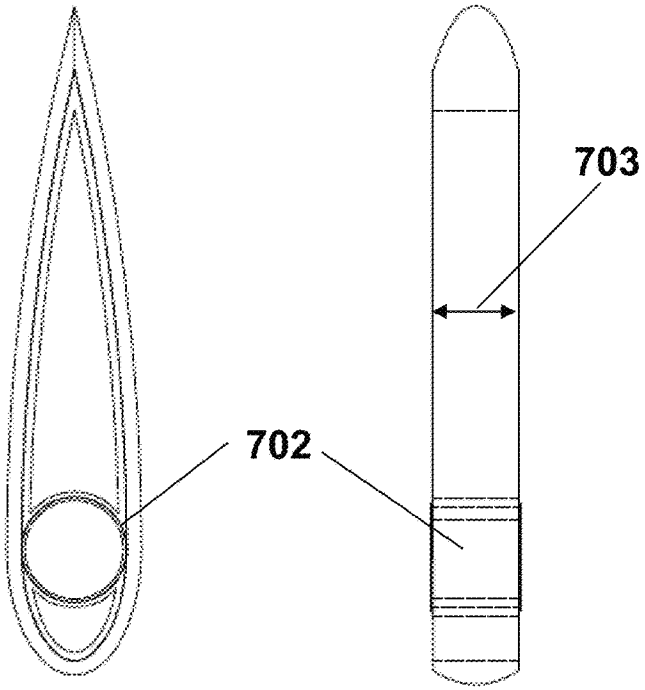
FIG. 7D
FIG. 7B
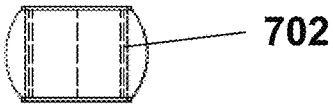
FIG. 7C
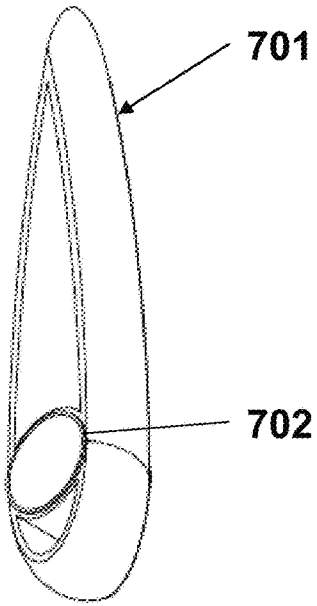
FIG. 7A

LAMINAR FLOW RADIAL CEILING FAN

BACKGROUND OF THE INVENTION

The invention disclosed herein maintains a level of human comfort within a dwelling by employing the forced movement of air. When temperatures are warm, this artificial breeze aids in feeling cooler as the breeze passes over one's body.

A preferred embodiment of the invention is a ceiling fan. The job of any fan is to convert the motion of the fan, typically the motion of flat pitched blades, into movement of air. The prior art employs blades rotated by motor which causes the movement of air to create an artificial breeze.

Since the middle of the $20^{th}$ Century systems such as central air-conditioning were incorporated in dwellings, to control the internal temperature of homes during summer months. Those systems added heating elements to have a singular central system for the home owner. However, limitations in the distribution of the heat or cold produced by these systems have demonstrated that an uneven distribution within a room or enclosed area of a structure lends itself to the addition of a ceiling fan to supplement the circulation of air within those confines for the comfort of the user.

As stated the deficiencies that are part of the heating and or cooling system have been partially addressed by the use of a ceiling fan that obviously increases the movement of air within the confines of a room, the normal operating state of the ceiling fan is for its operation to be continuous. This continuous operation occurs while the heating/cooling system is cycled from operating to its off state.

Another benefit of the prior art bladed ceiling fan is an overall reduction in energy consumption caused by the ability to alter the set temperature of the heating/cooling system to reduce its time of operation yet provide the user the level of comfort with a lower duty cycle of the centralized heating/cooling system.

The known physical property of air lends itself to the supplemental aid of a ceiling fan. To be specific, the fact that cooler air that has a greater density will seek a level lower with warmer air rising. The fan of the prior art will drive down the warmer air at the ceiling level in an attempt to create a higher state of movement within the confines of a room thus an attempt to equalize the distribution of the cool air when the cooling air source system is in use. Most ceiling fans of the prior art incorporate an ability to reverse the flow of air by reversing the direction of rotation of the fan blades. The purpose of the reverse flow is to enhance the distribution of warm air when the central heating feature of the heating/cooling system is being used, during the winter months. During the reverse flow of operation the warmer air at the ceiling is circulated across the ceiling and the desired result is for this movement to create a circulation that distributes the room air with greater equality.

Important to note is that all of the ceiling fans of the prior art attempt to gain the improvements in comfort to the user by moving air parallel to the vertical surfaces of the room and thus perpendicular to the horizontal surfaces of the room. Thus the motion of the air circulation of the prior art is limited to a single column of forced air commonly found at the center of the room, or for lager rooms multiple fans are affixed to the ceiling. For the sake of clarity, we describe a preferred embodiment, a single unit mounted in the center of an average room in a typical single family dwelling.

As previously stated the pitched blade ceiling fan of the prior art forces a singular vertical column of air from the ceiling downward to the floor.

The prior art uses the movement of the single vertical column of air to strike one of the horizontal surfaces of the room thus requiring an abrupt 90 degree turn of that column of air. This, in turn creates inefficient turbulent air flow. Accordingly, the prior art is deficient in attempting to efficiently circulate the air and equalize or homogenize the natural hot and cold layers.

There is an alternative fan design. In its most basic set up, it consists of two flat parallel discs. The discs rotate which will rotate the air mass trapped between the discs. Centrifugal force acts on the air mass and expels it outward beyond the edges of the discs and into the surrounding air space. If the discs have some sort of pathway to allow new air to take the place of the expelled air then the rotating discs will circulate the air. Thus, rotating discs can circulate the air without the need of traditional fan blades.

The prior art has recognized this structure as a "Tesla turbine," a "Prandtl layer turbine" or a "disc-type" turbine. This design has been considered useful only in the context of water turbines or high pressure air applications such as in vacuum cleaner motors or jet engine turbines.

The Tesla turbine was considered impractical in the context of a room fan because at the standard air pressure of one atmosphere, it was thought, a Tesla turbine simply could not move a sufficient volume of air without being impractically bulky. The device would have required far too many discs, each disc being far too large and the discs would have to rotate at too high an RPM to be practical.

Surprisingly, the current inventors have found a practical design for a disc type fan operable at standard atmospheric pressures. Indeed, as will be seen by one skilled in the art the disclosed invention the disc type fan is not only practical, but it improves on prior art fan systems.

OBJECTS OF THE INVENTION

The following disclosure of invention "objects" is meant to describe examples, or preferred embodiments, to be used in comparing and contrasting the invention with the prior art. This disclosure is not, however, intended to limit the claimed invention in any way.

It is therefore a general object of the invention to provide a ceiling fan apparatus that will meet the objectives and minimize limitations of the type previously described.

It is a specific object of the invention to provide a ceiling fan that is forcing its output laterally to its plane of rotation at an increased laminar flow.

It is another specific object of the invention to provide complete circulation and mixing of air of different temperatures when used within the confines of a room.

It is another specific object of the invention to disperse its high volume of laminar flow air displacement in all directions (360°) parallel to its plane of rotation.

It is another object of the invention to have the air entering the ceiling fan to be unobstructed.

It is another object of the invention to have the output laminar flow air expelled without buffeting caused by the unobstructed input air.

BRIEF SUMMARY OF A PREFERRED EMBODIMENT OF THE INVENTION

In order to provide a solution to the deficiencies of the prior art, a preferred embodiment of the present invention provides a laminar flow radial ceiling fan, comprised of multiple disc(s) stacked about equally and having radial symmetry around a central axis. The fan operates by rotating the discs about the central axis. The rotating disc(s) are manufactured in a fashion that allows unobstructed air to enter from a central opening in the disc(s) and then exit in all directions via equal spaces between the array of disc(s) at a high volume of laminar flow, this unique air flow within the room eliminates any dead air when the preferred invention is in use. Prior art attempts to obtain increased laminar flow at useful rotational speeds customary to ceiling fans failed due to the relativity small input aperture.

Additionally the preferred invention improves upon the motion of air movement as a result of the relative low pressure wide input aperture. As air returns to the fan it does so as an inverse expanding cone of rotation. This conical shaped return air has its origin at the lowest point within the room (the floor) with its base expanding to the vertical boundaries of the room (the walls). The apex of this conical return air is the base of the fan at the input opening itself.

THE DRAWINGS

Objects and advantages of the present invention will become apparent from the following detailed description of embodiments taken in conjunction with the accompanying drawings, wherein.

FIGS. 7A-D show various views of an aerodynamic vane, a design variation which further promotes laminar air flow.

Figure 8:
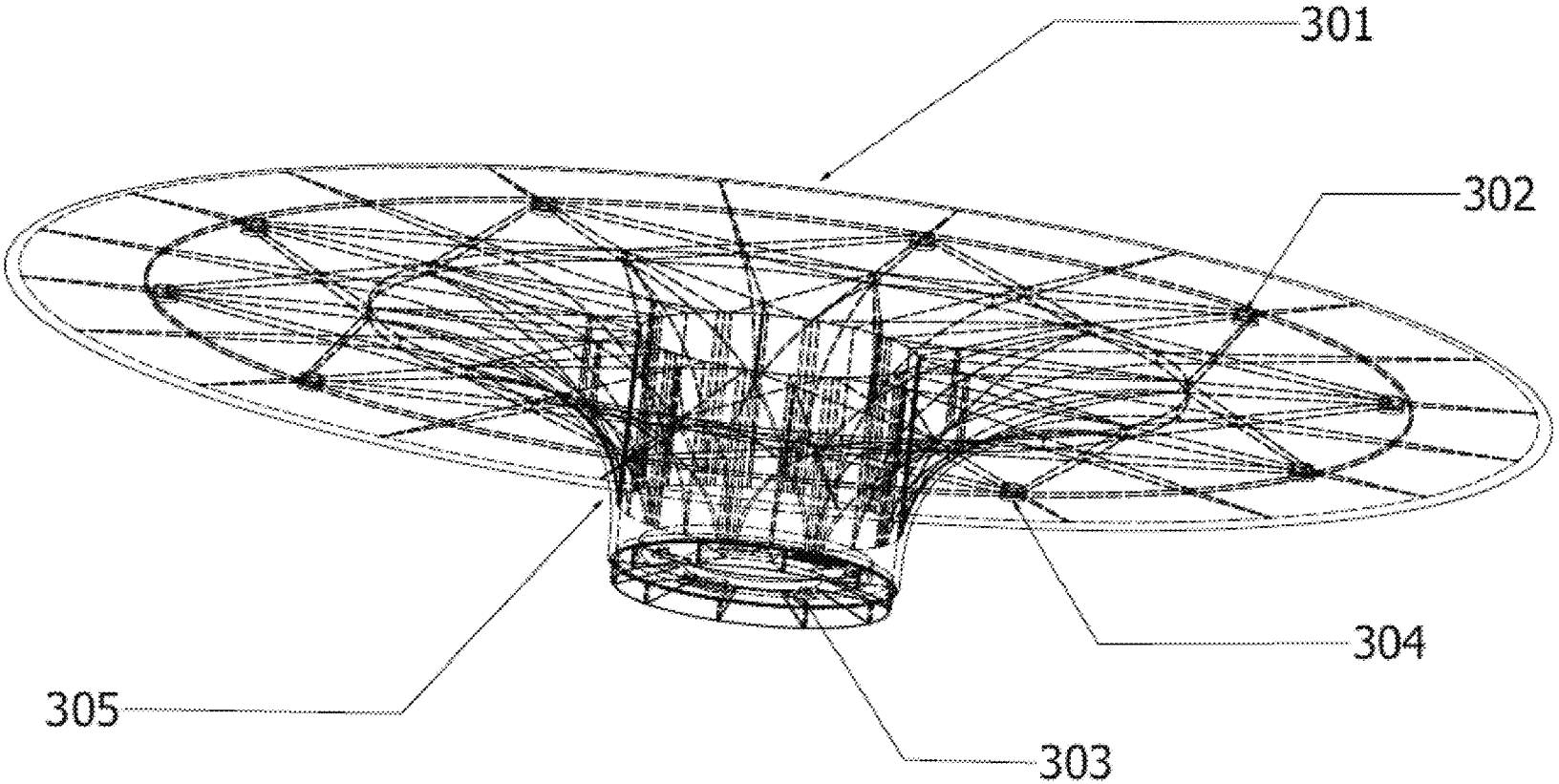

FIG. 8 is the top, or master, drive disc of a preferred embodiment which includes a motor attachment and a smooth conical shape to promote laminar air flow.

Figure 9:
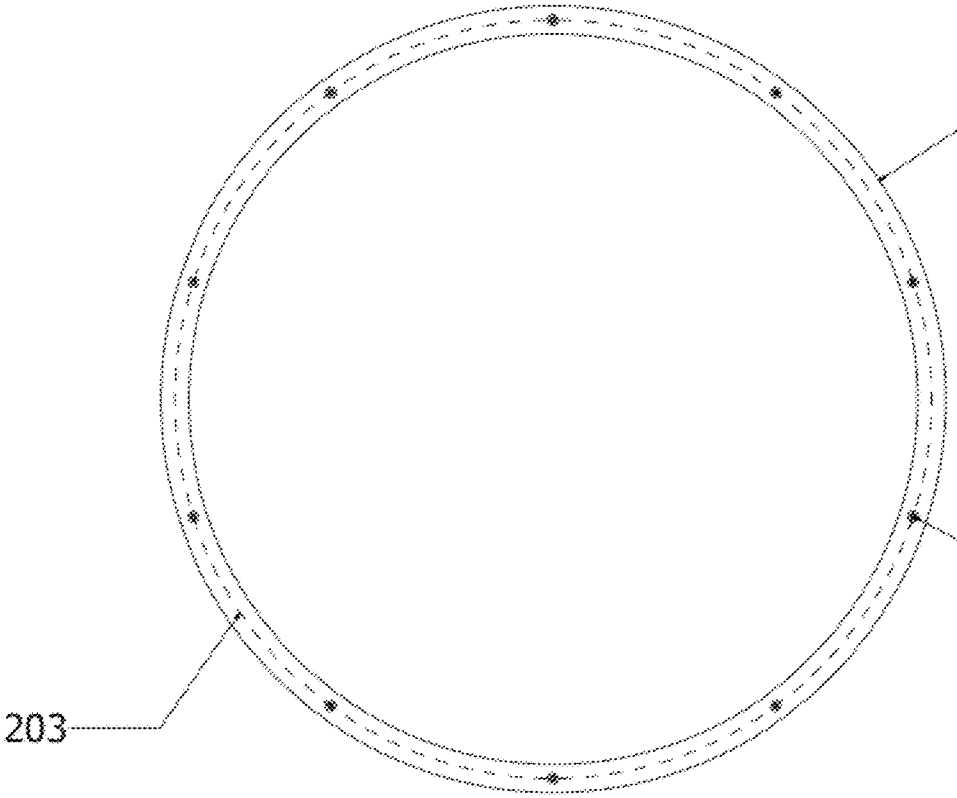

FIG. 9 is a top view of the attachment retention ring of a preferred embodiment.

Figure 10:
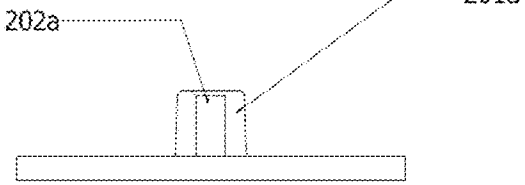

FIG. 10 is a cross-section of the bolt receiving cylinder which is mounted on the attachment retention ring of FIG. 9.

DETAILED DESCRIPTION

Figure 1:
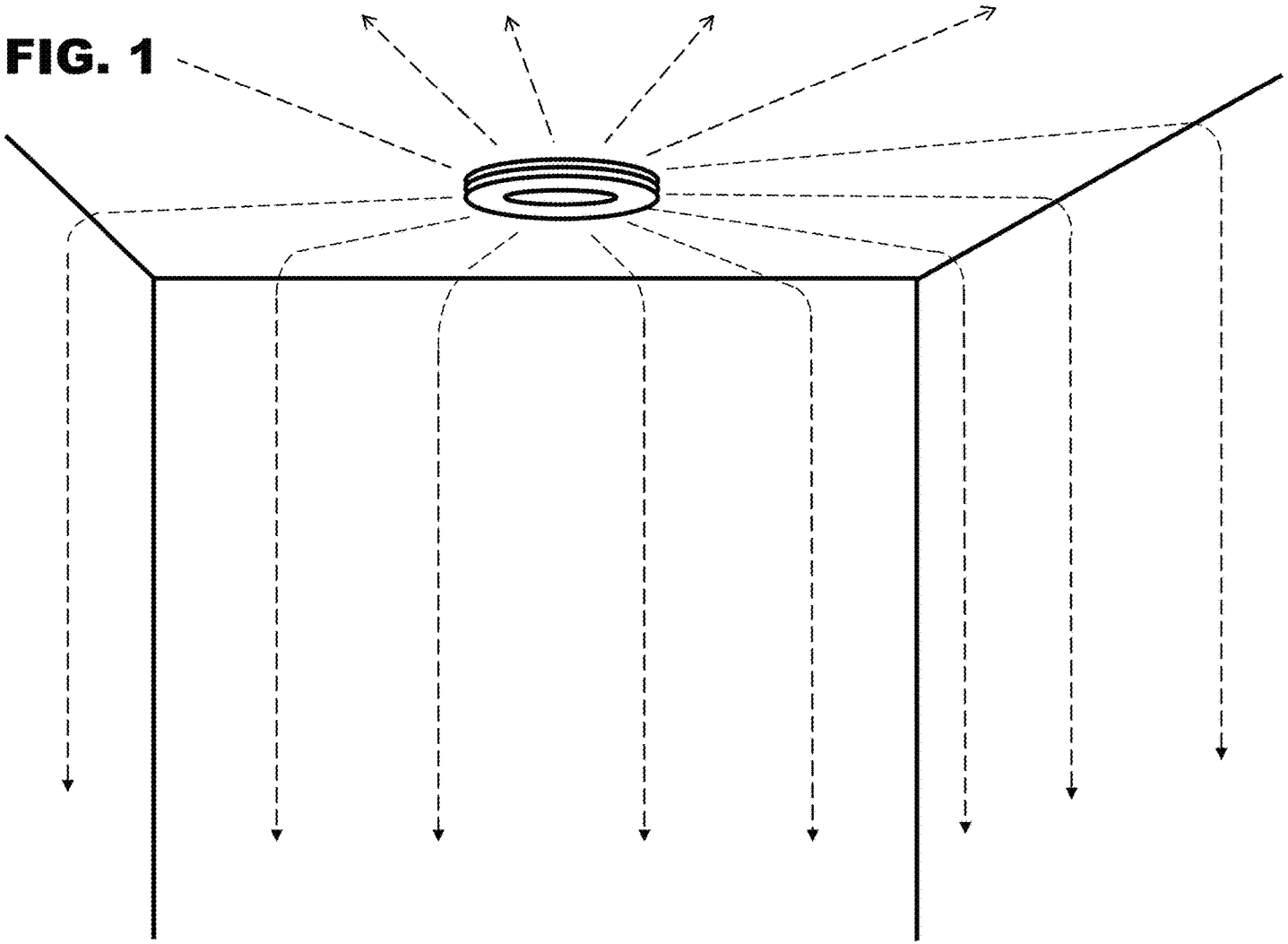
FIG. 1 illustrates a preferred airflow pattern for the air leaving the fan.
Figure 2:
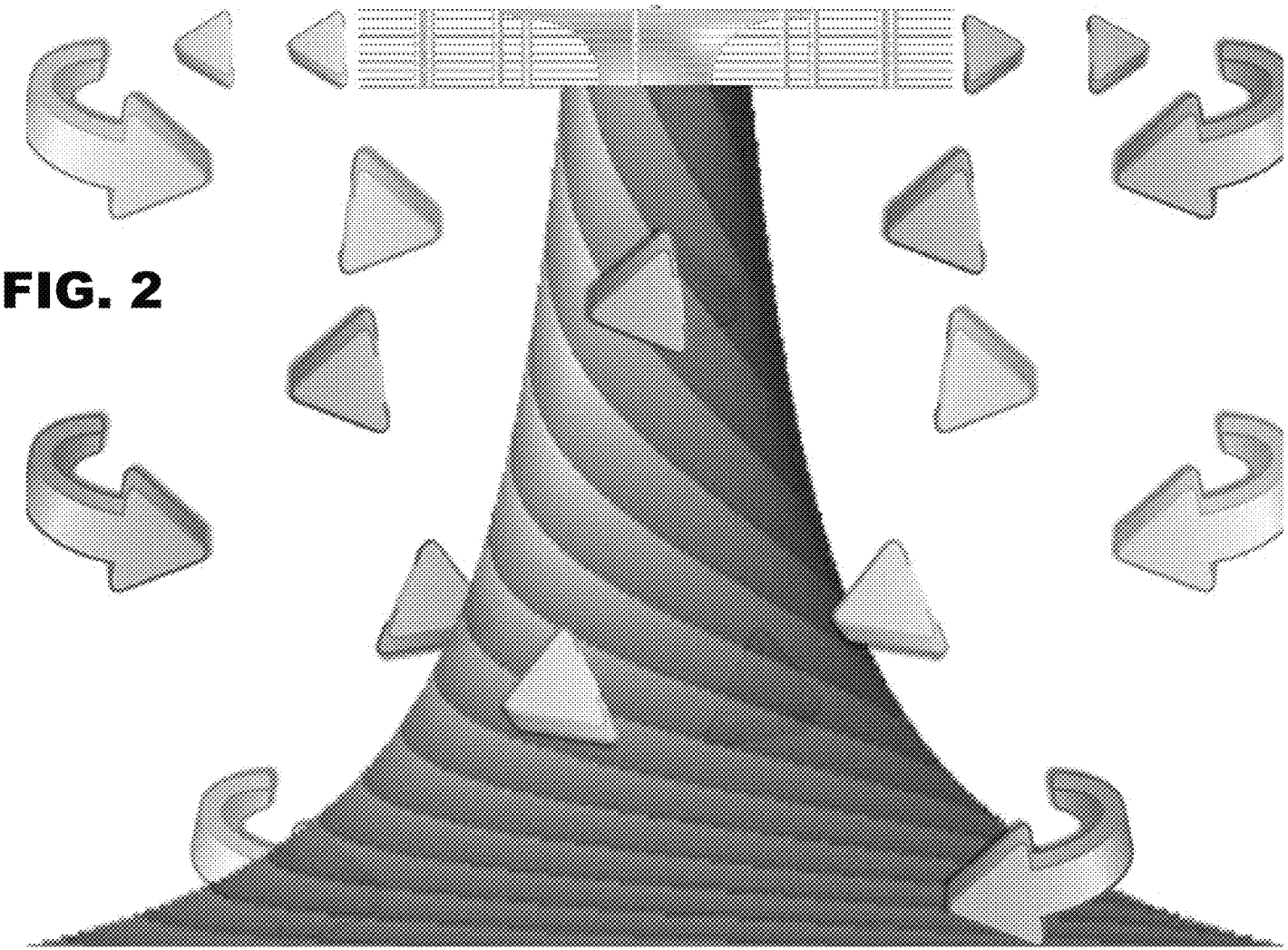
FIG. 2 shows a preferred airflow pattern highlighting the air return, a conical return pattern.

One improvement over the prior art is more efficient air circulation. Due to the plurality of discs, their specific size, shape and relative positioning, the fan generates, in a preferred embodiment, a laminar air circulation pattern that efficiently circulates air throughout a standard room. For example, when the fan is located in the center of the ceiling, the air exits the rotating discs horizontally across the ceiling, spreading out uniformly in all directions toward the walls of the room as shown in FIG. 1. At the walls, the air travels downward, parallel with the walls where the air flow turns inward along the floor and travels back toward the room center, see again FIG. 1. Next, the air rotates upward in an inverse cyclonic pattern toward an air return aperture located in the bottom of the fan as show in FIG. 2. Finally, the air enters the fan, through the air return aperture, and thus completing the circulation pattern.

This air circulation is the result of empirical experimentation in various functional fan designs, each of which combine various features of the fan, in particular, the disc dimensions, the disc number and the disc relative positioning.

Figure 3:
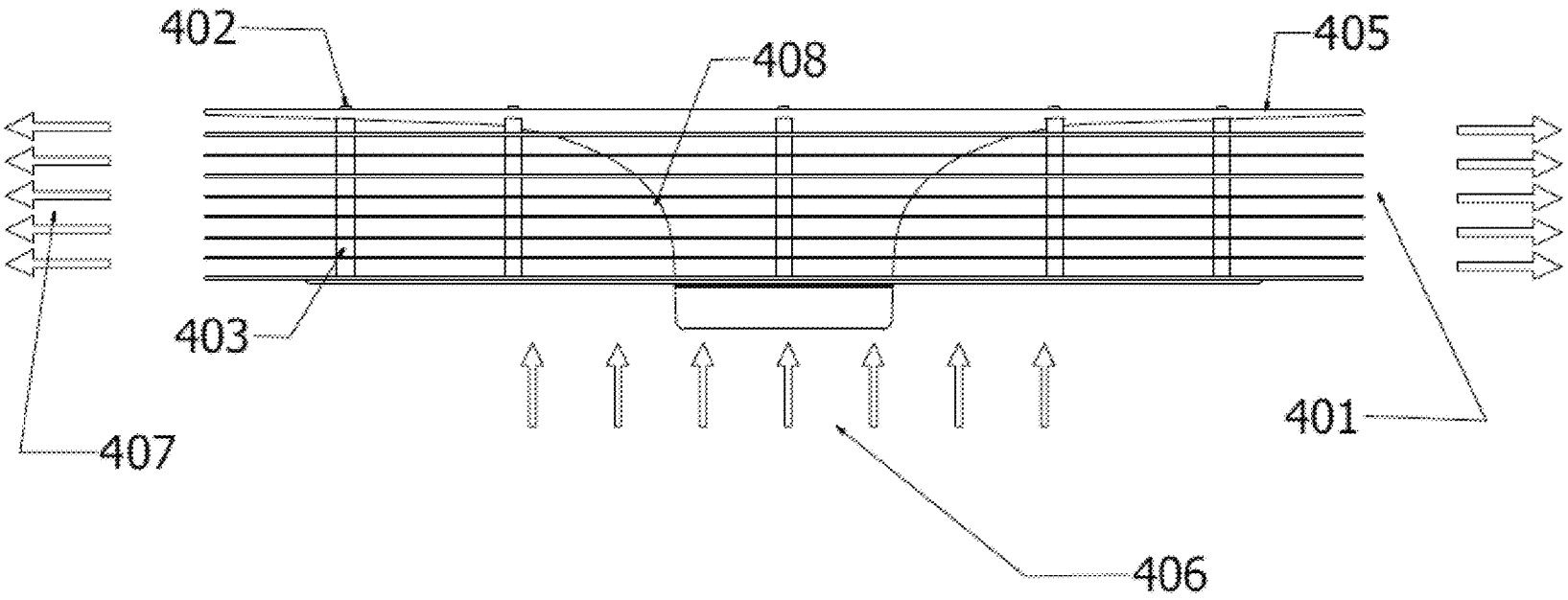
FIG. 3 shows the completed view of a preferred embodiment including the unique air flow paths exiting the fan and entering the fan.

These air patterns result from the fan illustrated in FIG. 3 which is a built up laminar flow ceiling fan also shown in exploded view in FIG. 4 below. The horizontal arrows 407 show the air exiting the fan beyond the edges of the slave discs 401. The returning air 406 is shown entering the fan through a central air return aperture, see also FIG. 5 103. As the air enters the fan it is smoothly directed outward by the conically shaped portion 408 of the master drive disc described in more detail in FIG. 8 below. This novel feature, directing an air current into and out of a fan without significantly disrupting the laminar flow of that air current is an unique property utterly absent from the prior art.

The FIG. 3 embodiment comprises one master, or drive, disc 405 mounted above an array of eight (8) slave discs 401 below. The through bolts 402 attaching the master disc to the slave discs are threaded through vertical spaces 403 that keep the slave discs 401 parallel and spaced apart a predetermined distance. The master disc also features a smooth invented cone shape that directs air entering through the air entry path 406 to the laminar flow output 407 shown at the side of the array.

Figure 4:
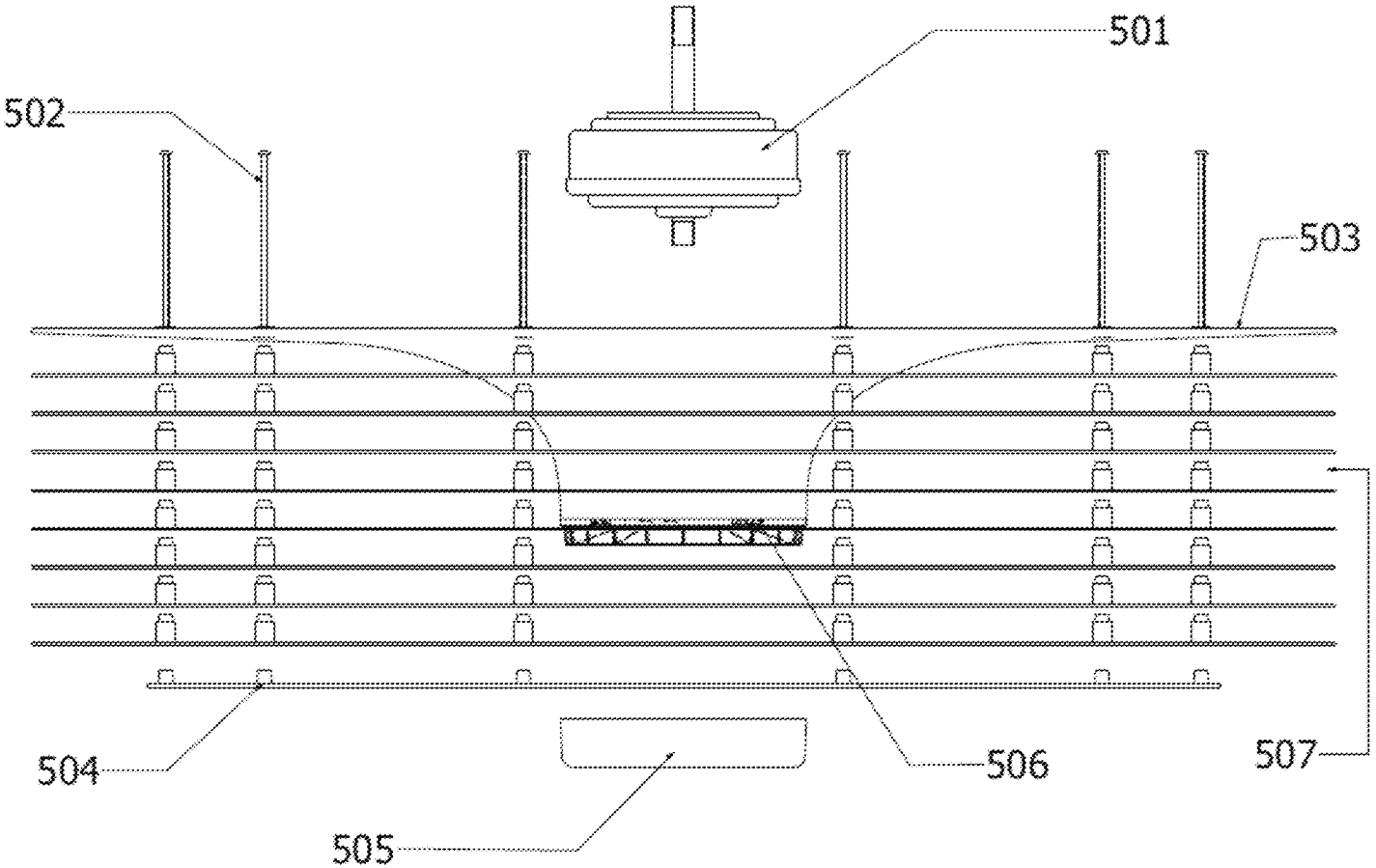
FIG. 4 shows an exploded view of the preferred invention.

FIG. 4 is an exploded view of the complete fan. The electric motor is 501. Through bolts 502 travel through the entire array, binding the entire slave disc array to the master drive disc 503, and terminate at the attachment and retention ring 504. The base air guide 505 covers the motor mounting screw assembly 506 during fan operation but can be removed during fan assembly and servicing. This assembly connects the motor 501 to the master drive disc 503.

The completed slave disc array 507 and master drive disc 503 are shown assembled and affixed to the stationary drive motor 501 by affixing five (5) machine screws through the master drive disc motor mounting screw holes 506 completing the construction of the preferred invention. The motor 501 rotates the entire master drive disc and slave disc array 503 and 507 respectively.

Figure 5:
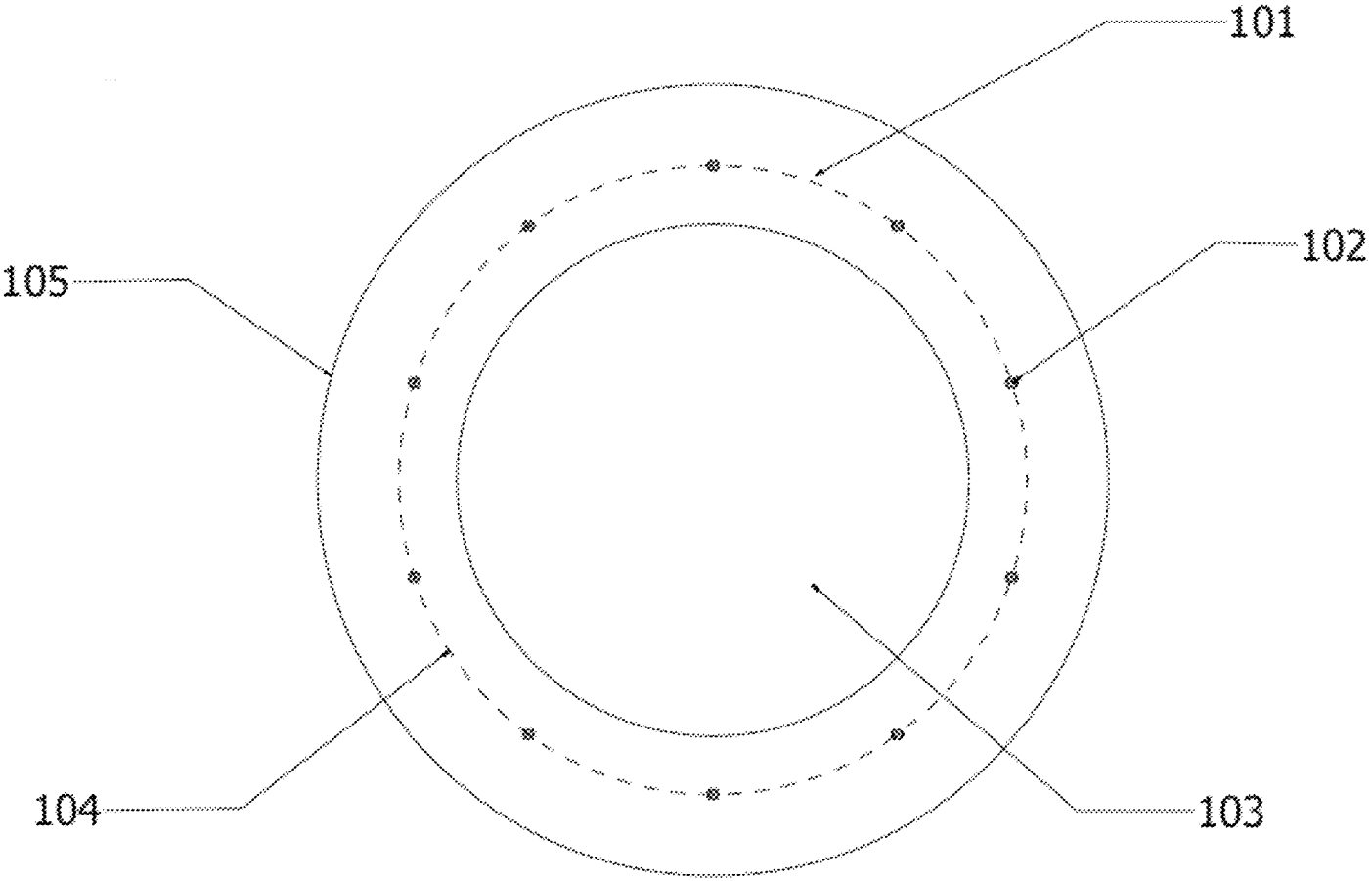
FIG. 5 is a top view of a single slave disc of the preferred invention.

FIG. 5 is a top view of a single slave disc 101 of a preferred embodiment. Each slave disc is preferably injection molded from raw plastic and manufactured identically with a circular opening. An air entry cavity 103 is present in the center of each disc. Each disc in the fan will have this cavity. When the discs are stacked together as shown in FIG. 3, the air entry cavities will create an air return aperture into which air will flow 406 as will be explained more fully below.

The slave disc 101 is preferably manufactured via plastic injection molding so as to create smooth surfaces on both sides. A smooth surface is a preferred surface for promoting laminar flow on a rotating disc(s) 101. Of course any surface designed to promote laminar flow will function in the invention. This is particularly true in high end designs where advanced aeronautical engineering can be employed.

The diameter of the air entry cavity 103 is derived with the following equations. The disc inner diameter (ID) is a function of the surface area (A) of a single disc as follows:

$$ID=\sqrt{A}$$

The outer diameter (OD) of the slave disc 105 is determined as follows:

$$OD\cong 1.5\times ID$$

or, more precisely:

$$OD = \sqrt{\frac{4+\pi}{\pi}} \times ID$$

Of course, some variation in the exact ID:OD ratio is allowable. Indeed, under specific conditions (room size, atmospheric pressure) some testing can be carried out and variations of 2, 5, 10 and up to 15 percent could be necessary to achieve optimal performance.

In a preferred embodiment, the surface area (A) is about 500 sq. inches, the outer diameter (OD) is about 34 inches and the inner diameter (ID) is about 23 inches.

An optimal number discs in the array 301 has been determined. The fan works more efficiently as one increases the number of slave discs from one (1) to eight (8). (Note, if one includes the master disc then this range is two (2) to nine (9).) In the preferred embodiment, there is a marginal, but significant increase in efficiency as one increases the discs in the array from seven (7) to eight (8). Surprisingly, eight appears to be an upper limit as no increase in efficiency is observed when one increases the number beyond eight.

Item 102 depicts an integral spacer with a vertical cylindrical or aerodynamic shape. The space between discs, the vertical dimension (V), is a function of the disc outer diameter (OD) and inner diameter (ID) as follows:

$$V=(OD-ID)\times 0.0625$$

In a preferred embodiment, the vertical dimension (V) is 0.75 inches. More generally, in another preferred embodiment each of said discs are spaced apart at a distance of about 0.7 to about 0.8 inches. In still another preferred embodiment, the discs are essentially identical with an outer circumference is about 30 to 38 inches, and said disc inner circumference is about 20 to 24 inches.

While the preceding formula provides a useful solution for designing an embodiment of the claimed invention, there is of course, an allowable variance in the vertical dimension, but it is surprisingly small. We estimate that laminar flow will persist as one increases the vertical distance by about 10 percent but will have ceased after the vertical distance is increased by 100 percent. Of course, for high end uses one can determine the maximum vertical dimension limit for a particular embodiment by brute force experimentation. One simply builds various fans with different vertical dimensions until one finds the optimal distance for which laminar flow predominates over turbulent flow and maximizing the air volume moved.

Figure 6:
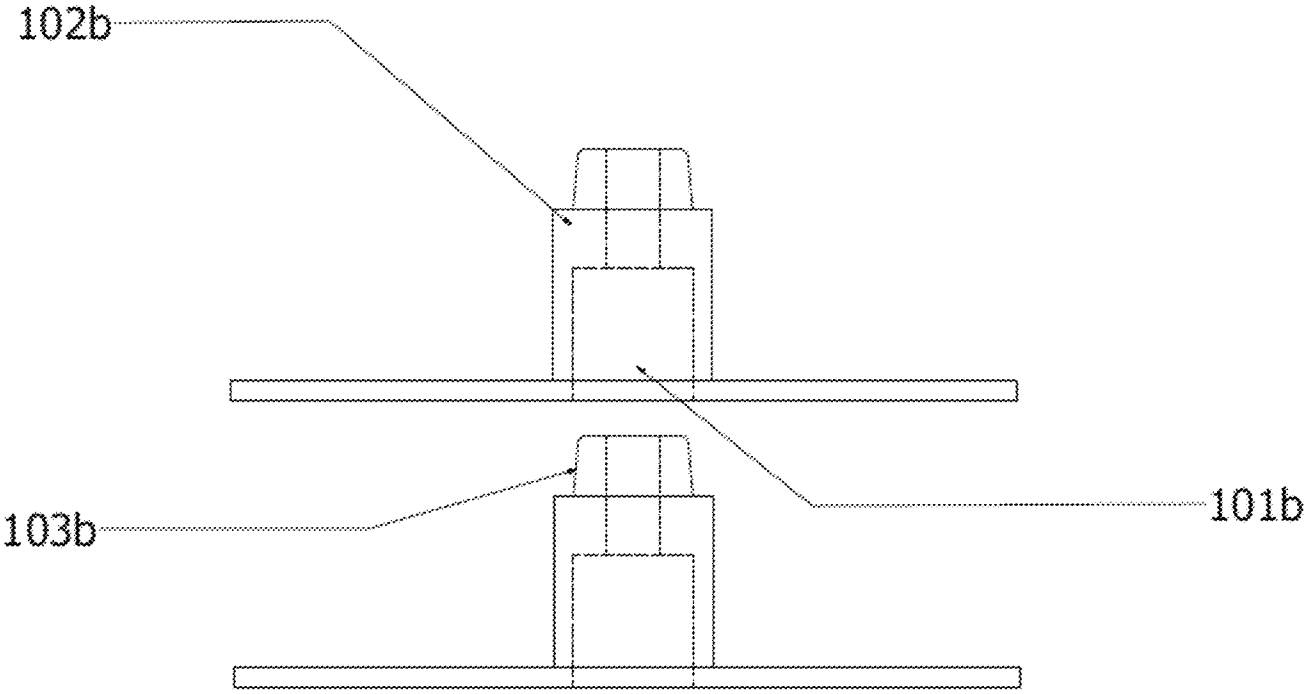
FIG. 6 is the cross section view of two vertical spacers illustrating the mating cavity.

FIG. 6 is a vertical cross section of the spacers. A set of spacers are distributed around the slave disc in a uniform circular pattern at a distance that is, in a preferred embodiment, one third (⅓) of the distance from the ID of the disc to the OD of the disc. In a preferred embodiment, a total of 10 integral vertical spacers are molded along the arc signified by the dashed line 104 in FIG. 5 and dispersed equally as described above.

FIG. 6 illustrates a preferred design allowing for vertical stacking of the spacers. As described above, the spacer(s) 102 provide for uniform vertical separation by and between each disc in the slave disc array 401 and feature a center hole 102*a* that allows the through bolt 402, 502 to pass through the disc array. In addition, the integral spacer has a mating attachment and alignment cavity 101*b* that conforms to and accepts the vertical spacer counterpart 102*b* that will result in the next successive disc to rest on the shoulder 103*b* of the vertical spacer.

FIGS. 7A-D illustrate laminar airfoil vane which can, optionally, be connected in the vertical spacers of FIG. 6. FIG. 7A is an axonometric view. FIG. 7B is a top view. FIG. 7C is a front view and FIG. 7D is a right side view. The height 703 of each vane 701 is less than that of the vertical spacer to which the vane is mounted and the diameter of the mounting hole 702 is slightly larger than the outer diameter of the vertical spacer. Taken together, these features allow the vane to rotate freely. The entire vane can change its angle of attack to align with the incoming laminar air movement which can vary from time to time due to changes in air speed, changes in motor RPM etc. These vanes 701 augment the output air speed due to the centrifugal force of a vertical vane rotating and placed in the path of the incoming laminar flow air. The effect is similar to that that of taking a flat piece of cardboard and waving it in front of one's face to create a cooling breeze.

The vane as illustrated is a preferred embodiment and may take on differed shapes depending on the type of laminar airfoil desired. The vanes can also be made stationary if so desired.

FIG. 8 is a depiction of the top master drive disc 301 which provides the attachment base for the slave disc(s) array 401 and the drive motor through motor mounting holes 303. The master disc 301 is preferably molded as a single piece. The master drive disc 301, in axonometric view, shows the bolt through holes 302 that allow the bolt to pass through and connect to attachment retention ring 201. Note that the alignment cavity 304 pattern is identical to that of FIGS. 5 and 9 so that the through bolts and the vertical spacers 102 can pass from the upper most disc through the array to the retention ring on the bottom of the fan. Note again that the master drive disc has a conical conformal air guide 305 that aids the entry of air as well as increasing the laminar flow by providing an unobstructed air passage into and out of the rotating disc array.

FIGS. 9 and 10 illustrate the retention ring and retention ring bolts, respectively. The attachment retention ring 201 is shown in top view. The purpose of the retention ring is to receive the bolts that pass through the master drive disc 301, see FIG. 8, and each slave disc 101 in the disc array. FIG. 10 shows an alignment and retention ring bolt receiving cylinder 201*a*, 202*a* designed to recess into the bottom slave disc 101 and is formed to accept the threaded bolt through a central hole 102*a*, of the bolt receiving cylinder. These retention bolts are distributed in a pattern that will match that of the integral vertical spacers 201. This pattern is depicted by the dashed line 203. The bolt receiving cylinder 201*a* is conformal to the alignment cavity 101*b* at the bottom of the bolt. The attachment retention ring 201 is affixed to the bottom disc of the array 401 so that its top surface is flush to the bottom most disc.

The preferred invention as a unit will have the number of discs as described by the aforementioned equation. The operational rotational speed of the preferred invention is within the normal range for a conventional ceiling fan. The motor 501 is designed to accommodate various speeds depending on the user's desired rate of laminar flow air. The formula below can be used to describe the force of the airflow. This is defined as the difference in pressure generated by the air exiting the fan over the surrounding air pressure, (P2−P1).

$$P2 - P1 = \frac{(\text{fluid density} \times \text{angular } velocity^2)}{2(R2^2 - R1^2)}$$

where the "fluid density" is the standard air density and R2 and R1 are the distances to the disc outer edge and inner edge, respectively, as measured from the disc center of rotation.

As described above, the air flow patterns of prior art fans are inefficient. They are generally limited to creating a single column of air that displaces the surrounding air. The size of this air column is limited by the diameter of the blades rotating about the hub of the fan. Also, the air column exits a fan located in the center of the room, in a typical installation, where the air column has a limited effect at any point lateral to that air column until contact is made with a horizontal surface of the room. During the summer the air column, somewhat cooler and denser then the surrounding air, will deflect downward which will allow hot air to collect near the ceiling, a very inefficient way to cool a room.

In describing the invention, references are made to preferred embodiments and illustrative advantages of the invention. Those skilled in the art and familiar with the instant disclosure of the subject invention may recognize additions, deletions, modifications, substitutions, and other changes which fall within the purview of the subject invention and claims.

For example, one of the embodiments described above has eight (8) discs in the array as an optimal number. This array size, however, is dependent on the fan being designed for household use in an ordinary sized room. There is, however, no theoretical reason that a fan be this particular size. Indeed, given the appropriate budget, one could design a fan array suitable for large industrial spaces. In these applications, the air return aperture would be larger and the optimal number of discs in the array could be much greater. Most likely, these larger discs would be more expensive to manufacture. The discs would be subject to greater centrifugal forces and this, in turn, would require proportionally stronger, more expensive, materials. Nevertheless, there are no theoretical problems with constructing an array that could handle a large warehouse or an aircraft hangar. The device can also be placed in a room in buildings such as a private residence, a retail business space, a front office business space and a back office business space.

In addition to the design features described above, the inventors specifically envision that any air dynamic feature that promotes laminar flow will be useful in certain embodiments of the claimed invention. This description has mentioned only a few, rather cost effective features. Depending on the budget available, additional features also become suitable.

SUMMARY OF MAJOR ADVANTAGES OF THE INVENTION

After reading and understanding the foregoing detailed description of an inventive laminar flow ceiling fan in accordance with preferred embodiments of the invention, it will be appreciated that several distinct advantages of the subject laminar flow ceiling fan are obtained.

At least some of the major advantages include providing a disc array 401 made of plastic and injection molded with integral vertical spacers. The disc array is easily constructed without a jig due to the integral vertical spacers 102 that allow the vertical stacking of the discs to be accomplished. The completed disc array 401, when rotated by drive motor 501 will intake unobstructed air via the open air entrance 406 and expel the laminar flow air at a high volume and lower RPM, relative to the prior art, in all directions 360 degrees parallel to the direction of rotation. When used and in relation to the prior art ceiling paddle fans the induced circulation of the preferred invention homogenizes the air within the room to cause even temperature distribution of the heated or conditioned air within without any change to its direction of rotation.

What is claimed is:

1. A method of producing a laminar flow air circulation comprising:

an apparatus comprising:

a plurality of discs oriented parallel, spaced apart and sharing a common central axis, including a bottom most disc, each disc having an outer circumference and an inner circumference, said inner circumference defining a centrally located aperture;

wherein each of said discs are spaced apart at a distance of about 0.7 to about 0.8 inches, a post located at a central axis of said apparatus and having an outer surface, said plurality of discs mounted about said post so as to form an air return space between the surface of the post and the inner circumference of said bottom most disc, wherein said plurality of discs range in number from 5 to 8, said discs mounted such that they freely rotate around their central axis, and said post outer surface having a conical shape such that it acts as an air guide that directs the incoming air without turbulence, said laminar flow being produced through method steps comprising:

rotating said discs at a speed sufficient to cause air to flow up into the air return space, along the post air guide surface which redirects the air flow from upward to outward without generating turbulence, then outward between the discs, out beyond the disc outer circumference and a surrounding air space, wherein said method steps operating upon said apparatus produce generally laminar flow air circulation in the surrounding air space.

2. The method as defined in claim 1 wherein the surrounding air space is a room in a building selected from the group consisting of: a private residence, a retail business space, a front office business space and a back office business space.

3. The method as defined in claim 1 wherein said plurality of discs comprise a single drive disc which is driven by a motor and 4 to 7 slave discs which are driven by said drive disc.

4. The method as defined in claim 1 wherein each of said discs are essentially identical, said disc outer circumference is about 30 to 38 inches, and said disc inner circumference is about 20 to 24 inches.

5. The method as defined in claim 1 wherein vertical spacers, mounted between said plurality of discs, hold said discs spaced apart, said vertical spacers further comprising laminar airfoil vanes.

6. An apparatus comprising:

a plurality of discs oriented parallel, spaced apart and sharing a common central axis, including a bottom most disc, each disc having an outer circumference and an inner circumference, said inner circumference defining a centrally located aperture;

wherein said plurality of discs range in number from 5 to 8;

a post located at a central axis of said apparatus and having an outer surface, said post having an outer surface having a conical shape such that it acts as an air guide that directs the incoming air without turbulence, said plurality of discs mounted about said post so as to form an air return space between the surface of the post and the inner circumference of said bottom most disc, wherein each of said discs are spaced apart at a distance of about 0.7 to about 0.8 inches and said discs mounted such that they freely rotate around their central axis, wherein the size of said air return space, the outer surface shape of said post, the distance space of said plurality of discs, the number of discs and the speed of rotation are all configured to produce a generally laminar flow air circulation in a space surrounding the apparatus.

7. The apparatus as defined in claim 6 wherein the surrounding air space is a room in a building selected from the group consisting of: a private residence, a retail business space, a front office business space and a back office business space.

8. The apparatus as defined in claim 6 wherein said plurality of discs comprise a single drive disc which is driven by a motor and 4 to 7 slave discs which are driven by said drive disc.

9. The apparatus as defined in claim 6 wherein each of said discs are essentially identical, said disc outer circumference is about 30 to 38 inches, and said disc inner circumference is about 20 to 24 inches.

10. The apparatus as defined in claim 6 wherein vertical spacers, mounted between said plurality of discs, hold said discs spaced apart, said vertical spacers further comprising laminar airfoil vanes.

* * * * *